United States Patent [19]

Borchart

[11] 4,127,837

[45] Nov. 28, 1978

[54] INDICATING DEVICE FOR FUSE-LINKS MORE PARTICULARLY MINIATURE FUSE-LINKS

[75] Inventor: Hans Borchart, Witten-Bommern, Germany

[73] Assignee: Wickmann Werke Aktiengesellschaft, Germany

[21] Appl. No.: 764,521

[22] Filed: Jan. 31, 1977

[30] Foreign Application Priority Data

Jan. 31, 1976 [DE] Fed. Rep. of Germany ..... 2603708

[51] Int. Cl.[2] ..... H01H 85/30

[52] U.S. Cl. ..... 337/265; 337/243

[58] Field of Search ..... 337/241, 243, 265, 266

[56] References Cited

U.S. PATENT DOCUMENTS

| | | | |
|---|---|---|---|
| 1,857,019 | 5/1932 | Hassell et al. | 337/265 |
| 1,996,432 | 4/1935 | Miller et al. | 337/265 |
| 2,115,428 | 4/1938 | Quisling | 337/265 |
| 2,702,329 | 2/1955 | Dietz, Jr. et al. | 337/265 |

*Primary Examiner*—George Harris

*Attorney, Agent, or Firm*—Robert E. Burns; Emmanuel J. Lobato; Bruce L. Adams

[57] ABSTRACT

A miniature fuse comprises a casing mounted on a base member and having a meltable fuse-link housed within the casing above the upper surface of the base member. The casing has a transparent portion and a substance of contrasting color with respect to the upper surface of the base member is interposed between the casing transparent portion and the base member upper surface. The substance is heat-sensitive to temperatures at and above those at which the fuse-link melts and undergoes a reaction in which the substance is consumed by the heat generated during melting of the fuse-link. The state of the fuse can be readily determined by viewing the transparent portion of the casing and when the fuse is in its non-blown state, the color of the substance is visible through the transparent portion whereas when the fuse blows, the substance is consumed and the contrastingly colored upper surface of the base member becomes visible through the transparent portion thereby indicating the blown state of the fuse.

5 Claims, 3 Drawing Figures

INDICATING DEVICE FOR FUSE-LINKS MORE PARTICULARLY MINIATURE FUSE-LINKS

The invention relates to an indicating device for fuse-links, more particularly miniature fuse-links, the casing of which is at least partially transparent.

Different kinds of indication of the state of the fusible conductor are known, depending on the kind and size of the fuse-links.

The prior art already discloses an indicating device with is small coloured plate — referred to as signal plate — which is located in a recess of a fuse cap and which is connected by means of an auxiliary wire to the fusible conductor. Since the signal plate is spring-loaded it leaves the recess of the fuse cap due to the spring pressure when the said connection is interrupted due to melting of the auxiliary wire. However, the undesirably wire undesirable affects the current-time characteristic of the fuse-link and the lower the nominal current of the fusible conductor the thinner must be the subsidiary wire so that the application of this indicating principle to fuse-links with a low nominal current range would be very difficult. Finally, the auxiliary wire is extended gradually subject to continous tensile forces acting on this wire.

Accordingly, after long time of use the signal plate projects from the fuse cap even if the fusible conductor has not yet been destroyed.

Similar difficulties arise with another kind of indicating device in which a loaded spring is also released when the auxiliary wire, parallel with the fusible conductor, melts and the spring in turn allows an indicator pin to snap forward from the fuse by means of a lever linkage.

The use of an explosive substance for indicating purposes is also known, the explosive substance being ignited by the arc which occurs when a fuse melts and said explosive substance in turn urges a pin or bolt to snap forward from the fuse casing to provide externally visible indication that melting has taken palce.

The previously-mentioned indicating device as well as the other previously known indicating means can be employed only for fuse-links of a rather large size for which the relatively complex construction of the indicating device can be tolerated.

The above-mentioned kinds of indicating devices cannot be applied to miniature fuse-links, on the one hand, because of the exceptionally small size of such fuse-links and, on the other hand, because of the position and relative arrangement of the supply wires and of the fusible conductor itself. In miniature fuse-links two supply wires usually pass at a distance from each other and parallel with each other through a base member composed of insulating material and the fuse connections are situated on one side of the base member and the other ends of the supply wires which project from the base member are bridged by a fusible wire. This construction does not permit the provision of supplementary wires or the like.

It is therefore an object of the present invention to provide a simple indicating device for fuse-links which is versatile and can be employed more particularly for miniature fuse-links.

To solve this problem, a readily explodable substance in a quantity adequate for indicating purposes is provided in the region of the transparent casing part so that shape and/or colour of said substance changes by the heat liberated when the fuse melts. Advantageously, the substance comprises low-nitrided cellulose in the form of fine fibres, also known as collodion cotton, nitrotuluene, a carbohydrate saturated with potassium chlorate or some other substance of comparable action, a quantity of which, sufficient for indicating purposes, being situated beneath the transparent casing part in the form of a lump, cap or the like. In the interests of simplicity, reference is made hereinafter predominantly to collodion cotton but without the readily explodable substances being restricted to collodion cotton.

The invention is based on the principle of utilizing the change of appearance, i.e. particularly shape and/or colour of substances on reaching temperatures corresponding to those of a melting fusible conductor for indicating purposes in fuse-links. To this end, the substance is arranged within the fuse-link in the region of the transparent casing part where the shape and/or colour of the substance can be readily detected and the substance is associated with the fusible conductor so that the temperature resulting from the melting thereof acts on the substance.

A particularly simple indicating device is obtained by the use of fine-fibre substances of which examples are mentioned hereinabove. These can be readily shaped and can be formed as a ball, cap or the like in the free part of the fuse-links beneath the transparent casing part.

In the case of miniature fuse-links in which a transparent hood can be placed on the top of the base which has a fusible conductor loop, it is advantageous that the free space beneath the hood is wholly or partially filled with the heat-sensitive substance. Accordingly, the indicating device can be produced in a very simple manner by the collodion cotton or some other indicating substance being introduced in the form of a small ball into the transparent hood which in turn is placed on the base of the miniature fuse-link.

The primary advantage of the invention is that a readily producible and readily visible indication of the state of the fuse-link can be achieved for various types of fuse-links. This can be explained by reference to a miniature fuse-link. If the transparent hood thereof is filled, for example with fine-fibre collodion cotton, the said visible part of the fuse-link will have a distinctly noticeable white appearance. When the fusible conductor melts the collodion cotton ball disintegrates and is consumed without leaving any noticeable residue so that the appearance of the fuse-link in this state is defined by the normally black colour of the base which can be clearly seen through the transparent hood. Such black-white contrast in the two indicating states represents a very simple and at the same time reliable and easily noticeable means for indicating the specific state of the fuse-link.

The substance which reacts to the temperature produced when the fusible conductor melts can also be applied to the fusible conductor itself or in the case of extremely thin and small and hardly noticeable fusible conductor portions can be applied to an electrically non-conductive carrier which is attached to the fusible conductor, a coating of this kind being situated at least on the side of the carrier nearest to the fusible conductor. This alternative embodiement is intended more particularly for the use of substances the reaction of which on reaching the melting temperature of the fusible conductor results in a colour change of the carrier or produces a coloured precipitate on the interior of the transparent casing part to provide a clear indication after melting of the fusible conductor.

Embodiments of the invention are explained hereinbelow by reference to the accompanying drawings, in which.

Figure 1:
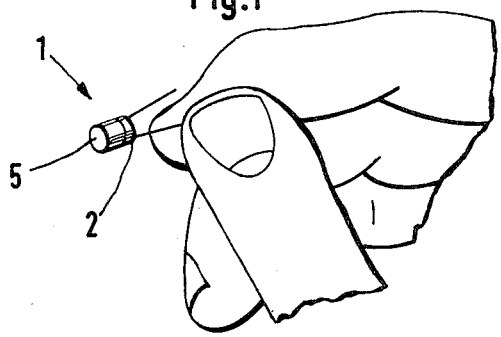
FIG. 1 is a diagrammatic view of a miniature fuse-link held in the fingers to illustrate the small size of this kind of fuse.
Figure 2:
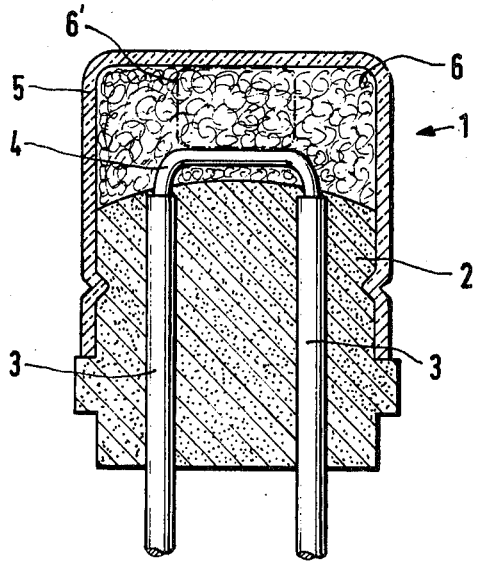
FIG. 2 is a sectional view of a miniature fuse-link which is provided with indicating means according to the invention.

A miniature fuse-link 1 illustrated in FIGS. 1 and 2 has a cylindrical base member 2, preferably constructed of a black insulating material, on which a transparent hood 5, consisting of glass of synthetic material, is mounted in the manner illustrated in the drawing. Two supply wires 3 pass through the base member 2, the top ends of said wires being connected by meltable fuse-link in the form of a fusible conductor loop 4. As can be seen by reference to FIG. 2, the fusible conductor loop extends through the space formed by the top endface of the base member 2 and the upwardly extending hood 5. A charge 6 of collodion cotton is disposed in the space and is in contact with the fusible conductor loop 4, namely by being pressed thereon. An insert 6' formed from collodion cotton, shown in dash-dot lines in FIG. 2 and occupying merely the middle part of the space between the hood 5 and the base member 2, while the outer annular space remains free, can be provided instead of the charge 6 of collodion cotton or the like which completely fills the space between the hood. In this case the insert 6' can be adhesively affixed in a middle position on the inside of the hood by means of a minute quantity of adhesive substance or the like so that when the hood 5 is mounted the insert 6' in every case bears upon the fusible conductor loop 4.

If a charge 6 is used, it is conveniently slightly compressed when the hood 5 is placed upon the base member 2 so as to provide the necessary contact with the fusible conductor loop 4.

In each of the abovementioned cases, the hood 5 is provided with a white appearance due to the charge 6 or the insert 6' of white collodion cotton. This appearance is retained until the collodion cotton reacts due to the melting of the fusible conductor and as a result of the heat generated thereby and the temperature thus reached, the charge 6 is consumed and disappears practically without visible residue. The appearance of the hood 5 therefore changes from white to black. This is because the hood 5 assumes a black colour in accordance with the colour of the base member. This contrast can be readily detected so that the relevant state of the fuse-link 1 can be readily inspected.

Figure 3:
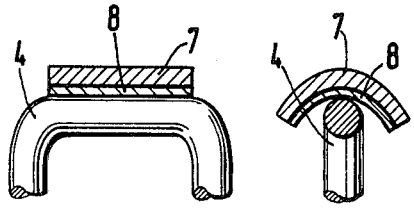
FIG. 3 shows two sectional views of a fusible conductor loop of a fuse-link in which the fusible conductor loop is provided with a carrier for indicating substances.

In the embodiment according to FIG. 3, a coating 8 of a substance which reacts on reaching the temperature associated with the melting of the fusible conductor loop 4, namely by evaporating with the consequence of a preferably coloured deposit on the inside of the hood, is applied either directly to the fusible conductor loop 4 or to a carrier 7 which is applied to the fusible conductor loop 4. For as long as the fusible conductor loop 4 remains integral, the hood 5 in this case will display the black colour of the base member. After melting of the fusible conductor loop 4 with the consequence of the reaction of the coating 8, the hood appears coloured in accordance with the colour of the deposit resulting from the coating 8.

I claim:

1. In an electric fuse of the type having a casing closed by a base member with a meltable fuse-link housed within the casing: an indicating device for providing a visible indication of the state of the fuse comprising means defining a transparent portion of said casing through which can be seen the upper surface of said base member; and a substance disposed within said casing in the region between the casing transparent portion and base member upper surface and being heat-sensitive to temperatures at and above those at which the fuse-link melts for undergoing a reaction in which said substance is consumed by the heat generated within said casing during melting of said fuse-link, said substance having a color which contrasts with that of said base member upper surface so that upon melting of said fuse-link and consumption of said substance, the contrastingly colored upper surface becomes visibly exposed through said casing transparent portion thereby indicating a change of state of the fuse.

2. A fuse according to claim 1; wherein said substance is selected from the group consisting of low-nitrided cellulose, nitrotoluene, and carbohydrate saturated with potassium chlorate.

3. A fuse according to claim 1; wherein said casing comprises a transparent hood; and said substance is in the form of fine fibers charged within said transparent hood covering said upper surface of said base member.

4. A fuse according to claim 3; wherein said fine fibers are white in color and said upper surface is black in color.

5. A fuse according to claim 1; wherein said substance is in the form of a plug interposed between said casing transparent portion and base member upper surface.

* * * * *